US009952008B2

(12) United States Patent
Watson

(10) Patent No.: US 9,952,008 B2
(45) Date of Patent: Apr. 24, 2018

(54) CLEANING OF HEAT EXCHANGER CORE

(75) Inventor: Michael Watson, Rayleigh (GB)

(73) Assignee: Tube Tech International Limited, Essex (GB)

( * ) Notice: Subject to any disclaimer, the term of this patent is extended or adjusted under 35 U.S.C. 154(b) by 1128 days.

(21) Appl. No.: 14/008,036

(22) PCT Filed: Mar. 23, 2012

(86) PCT No.: PCT/IB2012/051402

§ 371 (c)(1),
(2), (4) Date: Oct. 2, 2013

(87) PCT Pub. No.: WO2012/131552

PCT Pub. Date: Oct. 4, 2012

(65) Prior Publication Data

US 2014/0014141 A1 Jan. 16, 2014

(30) Foreign Application Priority Data

Mar. 28, 2011 (GB) ..... 1105164.6

(51) Int. Cl.
*F28G 1/16* (2006.01)
*F22B 37/52* (2006.01)
*F28G 15/02* (2006.01)

(52) U.S. Cl.
CPC ..... *F28G 1/166* (2013.01); *F22B 37/52* (2013.01); *F28G 1/16* (2013.01); *F28G 15/02* (2013.01)

(58) Field of Classification Search
CPC ..... B08B 9/023; F28G 1/16; F28G 1/166
See application file for complete search history.

(56) References Cited

U.S. PATENT DOCUMENTS 5,615,696 A * 4/1997 Lawler ..... B08B 3/024 134/104.2
5,778,831 A * 7/1998 Jameel ..... B05B 1/34 122/390
6,513,462 B1 2/2003 Shiraishi
2007/0102902 A1 5/2007 Kahrig
2009/0010378 A1* 1/2009 Haberman ..... F22B 37/486 376/316

FOREIGN PATENT DOCUMENTS

DE 515060 12/1930
EP 0584520 3/1994
EP 1170567 1/2002

OTHER PUBLICATIONS

International Searching Authority:, PCT International Search Report and Written Opinion dated Jun. 19, 2012, entire document.

* cited by examiner

*Primary Examiner* — Spencer E Bell
(74) *Attorney, Agent, or Firm* — Allen Dyer Doppelt & Gilchrist

(57) ABSTRACT

An apparatus is described for cleaning the exterior of a furnace heat exchanger that includes a bundle of finned convection or bare radiant tubes heated when in use by the flue gases of a heater furnace. The apparatus comprises a motorized carriage 10 guided for movement along the outer surface of the bundle in a direction parallel to the tubes and a holder 24 on the carriage for holding a lance 20 in a position relative to the carriage 10 that permits the lance 20 to penetrate between the tubes of the bundle and to be advanced along the core by the carriage while remaining in the latter position.

13 Claims, 1 Drawing Sheet

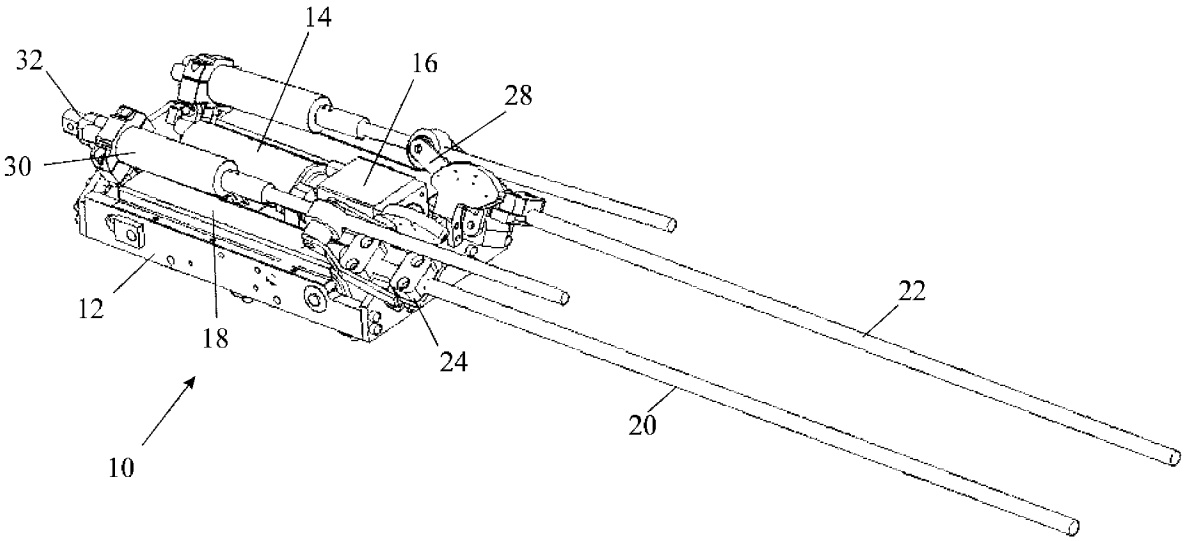
32
30
14
16
28
12
18
22
24
20
10

CLEANING OF HEAT EXCHANGER CORE

CROSS-REFERENCE TO RELATED APPLICATIONS

This application is the § 371 National Stage entry of International Patent Application PCT/162012/051402, filed on Mar. 23, 2012, which claims the benefit of United Kingdom Patent Application GB 1105164.6, filed on Mar. 28, 2011.

FIELD OF THE INVENTION

The present invention relates to cleaning of a heat exchanger and in particular a heat exchanger comprising a bundle of finned convection or bare radiant tubes heated by the flue gases of a furnace.

BACKGROUND OF THE INVENTION

In many industrial plants, such as refineries, a liquid is heated by flowing through a heat exchanger comprising a bundle of vertical or horizontal tubes over which pass the flue gases of a furnace. In some cases, the tubes are bare radiant tubes having smooth outer surfaces while in others each tube is a finned convention tube having closely spaced fins projecting from its outer surface to increase the surface area of the tube and thereby improve the heat transfer.

In use, because of incomplete combustion of the fuel burned in the furnace, a deposit of soot and other combustion products can form on the tubes, which causes serious deterioration in efficiency, if allowed to build up. To maintain good performance, it is therefore necessary to clean the tube bundles periodically.

It is known to clean furnace tube bundles by spraying them with a chemical. To enable a spray lance to be introduced between the tubes, the tubes of the bundle are arranged in a regular array, usually hexagonal, with a gap between the outer surfaces or the fins of adjacent tubes sufficiently wide to allow the spray lance to penetrate deep into the bundle.

Other on-line known ways of cleaning the outside of the tubes are to blow off the deposit with high pressure air using soot blower technology, to shock it off using fireball technology and on-line injection of abrasive blast and chemical media into the upward draft of the flame.

Offline cleaning technology may involve a person entering entry inside the furnace in order to apply high pressure water jets or other blast medium. All these systems have limited effectiveness as they cannot reach deep inside the furnace and in between fouled finned steel tubes which may be some 20 m long and comprises finned tubes of 15 cm diameter arranged six tubes deep in an array of triangular pitch formation.

A search carried out by the UK Patent Office revealed the existence of US published Patent Applications US2011/067651 and US2007/102902 and U.S. Pat. No. 6,513,462.

SUMMARY OF THE INVENTION

According to the present invention, there is provided an apparatus for cleaning the exterior of tubes of a heat exchanger which, when in use, are heated by the flue gases of a heater furnace, the apparatus comprising a carriage having a traction mechanism comprising motorised wheels or a pair of motorised caterpillar tracks which, in use, make frictional contact with the outer surface of the bundle to advance the carriage relative to the bundle and to guide the carriage for movement along the outer surface of the bundle in a direction parallel to the tubes, a holder fitted to the carriage, and a lance retained, in use, in the holder in a position in which the tip of the lance extends beyond the outer surface of the bundle and penetrates between the tubes of the bundle, the lance being advanced along the bundle by the movement of the carriage while remaining in the latter position.

The invention thus provides a heat exchanger cleaning robot that is guided by the tubes of the tube bundle and carries at least one lance for cleaning between the tubes, whether finned or not, as its carriage moves along the surface of the bundle.

US2007/102902 mentioned above has a carriage that directs a jet of liquid under pressure from outside the volume of the tube bundle. Such a method of cleaning is not very effective because the jet cannot reach very far into the bundle and can only clean surfaces that are in direct line of sight from outside the bundle. More seriously, the reaction force of the jet tends to lift the carriage off the tube bundle and weights need to be loaded onto the carriage to prevent this from happening.

By contrast, in the present invention, the lance penetrates into the tube bundle to achieve more thorough cleaning. Furthermore, in an embodiment of the invention, the lance has laterally directed jet so that the reaction from them does not act to lift the carriage off the tube bundle.

If the jets are aimed laterally and disposed symmetrically, there will be no reaction from them to interfere with the movement of the carriage. In an embodiment, it is possible to angle some jets slightly upwards (i.e. towards the carriage) to exert a downward force on the carriage.

While the apparatus of the invention can be used to spray a chemical onto the outer surfaces of the tubes of the bundles, it is preferred for each lance to be connected to water under high pressure and to clean the bundle by the force of one or more water jets discharged from the lance.

When relying on pressure jets to clean the tubes within the interior of the bundle, it is necessary to be able to move the lance in and out of the triangular or square pitched bundle so that its jet can reach different depths within the bundle.

It would be possible for the position of the lance to remain constant for a traverse of the length of the core by the carriage. Before a new traverse, the depth of the pressure jets may be reset by repositioning the lance manually in the holder at the start of each traverse.

To simplify the cleaning operation further, it is advantageous to provide an actuator on the carriage for changing the position of the lance relative to the carriage to alter the depth of penetration of the jets of the lance. Such an actuator may be operated remotely or automatically.

The actuator may simply move the lance in and out of the core while maintaining its attitude constant, but it is preferred for the lance holder to be pivotable relative to the carriage to move the jets and the lance along an inclined plane passing between the tubes of the bundle. Such a construction allows the actuator to be a simple hydraulic, a pneumatic jack or an electric motor.

The traction and guiding mechanism for advancing the carriage relative to the tube bundle may comprise wheels or a pair of caterpillar tracks in frictional contact with the outer surface of the bundle. If the bundle is horizontal, such wheels or track may suffice to guide the carriage but if the tubes of the bundle are vertical or inclined then additional guide rollers may be provided to engage the opposite sides of the outermost tubes in the bundle.

According to a second aspect of the invention, there is provided a method of cleaning the exterior of a heat exchanger including a bundle of tubes which are heated when in use by the flue gases of a heater furnace, in which a carriage is provided having a traction mechanism comprising motorised wheels or a pair of motorised caterpillar tracks, positioning the carriage on the bundle with the traction mechanism in frictional contact with the outer surface of the bundle, mounting a lance in a holder fitted to the carriage in a position in which the tip of the lance penetrates between the tubes of the bundle, and operating the traction mechanism to advance the carriage and the lance along the bundle.

The holder in an embodiment of the invention is pivoted relative to the carriage about an axis normal to a plane that passes between tubes of the bundle.

In one mode of operation, the lance may be swept through an arc, by pivoting the holder relative to the carriage, so as to clean a sector between tubes of the bundle, the carriage being subsequently advanced by an increment to commence the sweeping of an adjacent sector.

Alternatively, the lance may be kept stationary relative to the carriage during each pass of the carriage along the length the bundle and the holder may be pivoted between passes to change the depth of penetration of the tip of the lance beneath the outer surface of the bundle.

BRIEF DESCRIPTION OF THE DRAWING

The invention will now be described further, by way of example, with reference to the accompanying drawings, in which the single FIGURE shows a perspective view of an apparatus of the invention.

DETAILED DESCRIPTION OF THE PREFERRED EMBODIMENT

The apparatus or robot shown in the drawing comprises a carriage 10 having a rectangular outer open frame 12. An air drive motor 14 and a gearbox 16 are mounted on the frame 12 to drive two caterpillar tracks 18, arranged one on each side of the frame 12. The track on the far side of the frame 12 is obscured by the motor 14 and the gearbox 16.

The tracks 18, which may be replaced by a set of wheels, are inclined relative to the plane of the frame 12 and relative to one another so that their traction surfaces form a V-shape depending from the lower surface of the frame. As an alternative, the plane of the tracks may be parallel to the tube bundle and the tracks may be adjustable to allow for tubes of wider or narrower pitch. When the apparatus is placed on a bundle of tubes of circular cross section, the traction surfaces contact the facing surfaces of two adjacent tubes. In this way, the carriage is guided to remain in alignment with the two tubes and is propelled along the bundle when the tracks 18 are driven by the motor 14 through the gearbox 16. The carriage is further guided by two drop down guides which are actuated by a motor 32 situated at rear back of the frame 12.

Such an arrangement suffices if the tube bundle is horizontal but the carriage can also be designed to work with bundles inclined to the horizontal or vertical if additional idlers rollers are arranged to pass between the two top tubes and to engage the under surfaces of the two tubes. For example, the idler rollers may be mounted on a T-bar that can be rotated from an aligned position where it can pass through the gap between two adjacent tubes of the bundle, to a transverse position where the rollers engage the underside of the tubes to prevent the carriage from lifting off the bundle.

The carriage 10 supports two lances 20 and 22 connected to a high pressure water line and having jets that are aimed at the tubes of the bundle to clean them.

Each lance has laterally directed jets so that the reaction from them does not act to lift the carriage off the tube bundle. If the jets are aimed laterally and disposed symmetrically, there will be no reaction from them to interfere with the movement of the carriage. It is also possible to angle some jets slightly upwards (i.e. towards the carriage) to exert a downward force on the carriage.

Each lance 20,22 is clamped within a respective holder 24 that is mounted on the frame 12 in such a manner that it can pivot about an axis inclined to the plane of the frame 12. The angle of inclination is such that when the holder 24 is pivoted the lance 20 remains in a plane that passes between the tubes of the array. For example, if the tubes form a regular hexagonal array, each lance moves in a plane inclined at 30° to the frame 12 and the top surface of the bundle. This angle may be modified to suit the geometry of the bundle. A respective pneumatic jack 30 is connected to a bell crank arm 28 of each holder to allow the holder 24 to be pivoted. In place of a pneumatic jack 30, one may use an electric motor or a hydraulic actuator.

The described apparatus is capable of being controlled remotely by an operator or of being programmed to perform a cleaning operation automatically. Access to the tube bundle may in some cases be restricted to a small inspection opening adjacent the bundle. Though such an access opening may not be large enough to act as a keyhole through the entire bundle could be cleaned using a manually held lance, it is large enough to allow introduction of the described cleaning robot and its positioning on the bundle.

The robot is used by first advancing it to a desired position then swinging one or both of the lances in an arc using the jacks/motor 30. After a complete arc has been swept by both lances 20 and 22, the robot is advanced a small distance and the pivoting of the lances is repeated until the high pressure jets on the lances have scanned the whole of the two inclined planes defined by the gaps between the tubes of the bundle. Once the entire length of the bundle has been covered, the robot is repositioned on the next pair of tubes and the process is repeated until the entire bundle has been cleaned.

It would be possible to hold the lances stationary while making a pass of the robot over the length of the bundle and to reposition the lances slightly using the jacks 30 before making a return pass. However, this method of operation is not preferred as it results in the water and air supply lines being dragged over the bundle several times. By scanning the depth of the bundle then advancing the robot, the supply lines only move twice over the surface of the bundle for each pair of tubes.

When first positioning the robot on the tube bundle, it is necessary to first ensure that the traction surfaces can engage the tube bundle and that the lances are free to pivot. This may need to be carried out manually if the bundle is already partially blocked by the deposit.

It will be appreciated that various modifications may be made to the described apparatus without departing from the scope of the invention as set out in the appended claims. For example, electric motors may be used in place of the air motor and the pneumatic jacks 30. Instead of the penetration of the lances into the bundle being varied by pivoting the holders, it is alternatively possible for the holder to remain stationary and for the lances to be moved along the holders.

While it is currently envisaged that the robot will be remotely controlled by an operator at all times, it is possible for it to be programmed to perform the cleaning task automatically. In the latter case, the carriage may additionally be provided with sensors to detect when the end of a run has been reached or if one of the lances encounters an obstruction.

The invention claimed is:

1. An apparatus for cleaning the exterior of tubes of a heat exchanger which, when in use, are heated by the flue gases of a heater furnace, the apparatus comprising:

a carriage having a traction mechanism comprising motorised wheels or a pair of motorised caterpillar tracks which, in use, make frictional contact with an outer surface of a bundle of the tubes to advance the carriage relative to the bundle and to guide the carriage for movement along the outer surface of the bundle in a direction parallel to the tubes, a bottom of the carriage defining a lower plane;

a holder fitted to the carriage above the lower plane; and a lance retained, in use, in the holder in an inclined position relative to the lower plane such that the lance extends through the lower plane, and a tip of the lance is extendable below the lower plane and beyond the outer surface of the bundle to penetrate between the tubes of the bundle, the lance being advanceable along the bundle by the movement of the carriage while remaining in the inclined position.

2. The apparatus of claim 1, wherein the traction mechanism includes additional guide rollers positioned to engage the opposite sides of outermost tubes in the bundle to permit the apparatus to move along a bundle inclined to the horizontal.

3. The apparatus of claim 1, wherein the lance is connected to a fluid under high pressure and is operative to clean the bundle by the force of one or more water fluid jets discharged from the lance.

4. The apparatus of claim 3, wherein the fluid is water.

5. The apparatus of claim 1, wherein the lance has laterally directed jets.

6. The apparatus of claim 5, wherein the laterally directed jets are disposed symmetrically around the lance.

7. The apparatus of claim 1, wherein the lance includes at least one jet angled in the direction of the carriage.

8. The apparatus of claim 1, wherein an actuator is provided on the carriage for changing the position of the lance holder relative to the carriage to alter the depth of penetration of the tip of the lance into the bundle.

9. The apparatus of claim 8, wherein the lance holder is pivotable relative to the carriage to move the lance along an inclined plane passing between the tubes of the bundle.

10. A method of cleaning the exterior tubes of a heat exchanger using the apparatus of claim 1, the method comprising:

positioning the carriage on the bundle with the traction mechanism in frictional contact with the outer surface of the bundle;

mounting the lance in the holder fitted to the carriage in a position in which the tip of the lance penetrates between the tubes of the bundle; and operating the traction mechanism to advance the carriage and the lance along the bundle.

11. The method of claim 10, wherein the holder is pivoted relative to the carriage about an axis normal to a plane that passes between tubes of the bundle.

12. The method of claim 11, wherein the lance is swept through an arc, by pivoting the holder relative to the carriage, so as to clean a sector between tubes of the bundle, the carriage being subsequently advanced by an increment to commence the sweeping of an adjacent sector.

13. The method of claim 11, wherein the lance is kept stationary relative to the carriage during each pass of the carriage along the length the bundle and the holder is pivoted between passes to change the depth of penetration of the tip of the lance beneath the outer surface of the bundle.

* * * * *